United States Patent [19]

Jacobsen et al.

[11] 4,134,195

[45] Jan. 16, 1979

[54] METHOD OF MANIFOLD CONSTRUCTION FOR FORMED TUBE-SHEET HEAT EXCHANGER AND STRUCTURE FORMED THEREBY

[75] Inventors: Fred W. Jacobsen, Los Angeles; Stanley T. Jakubowski, Carson; Herman S. Weiner, Southgate, all of Calif.

[73] Assignee: The Garrett Corporation, Los Angeles, Calif.

[21] Appl. No.: 595,997

[22] Filed: Jul. 15, 1975

Related U.S. Application Data

[62] Division of Ser. No. 351,439, Apr. 16, 1973, Pat. No. 3,894,581.

[51] Int. Cl.[2] ..... B23P 15/26

[52] U.S. Cl. ..... 29/157.3 R; 29/157.3 B; 165/166; 165/152; 165/153; 165/151; 165/170; 165/173

[58] Field of Search ..... 29/157.3 R, 157.3 A, 29/157.3 B; 165/166, 151, 182, 152, 153, 170, 173

[56] References Cited

U.S. PATENT DOCUMENTS

| | | | |
|---|---|---|---|
| 2,511,084 | 6/1950 | Shaw | 257/245 |
| 2,752,125 | 6/1956 | Modine | 257/136 |
| 2,977,918 | 4/1961 | Kritzer | 29/157.3 B |
| 2,994,123 | 8/1961 | Kritzer | 29/157.3 B |
| 3,246,691 | 4/1966 | La Porte et al. | 29/157.3 A |
| 3,460,611 | 8/1969 | Folsom et al. | 165/166 |
| 3,702,021 | 11/1972 | Wolfe et al. | 29/157.3 B |
| 3,702,022 | 11/1972 | Duke et al. | 29/157.3 B |
| 3,785,435 | 1/1974 | Stein et al. | 165/76 |
| 3,796,258 | 3/1974 | Malhotra et al. | 29/157.3 B |
| 3,894,581 | 7/1975 | Jacobsen et al. | 165/166 |

*Primary Examiner*—C.W. Lanham
*Assistant Examiner*—V. K. Rising
*Attorney, Agent, or Firm*—Henry M. Bissell

[57] ABSTRACT

A heat exchanger plate of single unitary structure and relatively thin material has a deep draw formed through one surface adjacent to each of the opposite ends to provide fluid openings and a lesser depth inner draw formed in the other surface to provide a fluid passage communicating with the fluid openings. The plate is adapted to oppose adjacent plates in a stacked configuration to provide heat transfer between separate fluids flowing through counterflow passages on opposite sides of the plate. The recessed area on one surface of the plate forms a fluid passage with its adjacent plate in the stacked array for flow of a first fluid through the stack from side to side of an enclosing housing. A collar formed around each plate opening by the deep draw is adapted to nest with a corresponding collar of an adjacent plate to provide manifold sections communicating with a second fluid passage. The stacked configuration of corresponding plates establishes pluralities of first and second passages alternately arrayed for adjacent counterflow of separate fluids for maximal heat transfer between them. The nested plates may be brazed together, eliminating the necessity for slow and costly welding procedures to develop the strength required to withstand operating pressures. Finned elements positioned between the plates improve the efficiency of the heat exchange process. The structure is compact, light weight, strong and efficient in operation. The fabrication process is simplified and economical.

6 Claims, 9 Drawing Figures

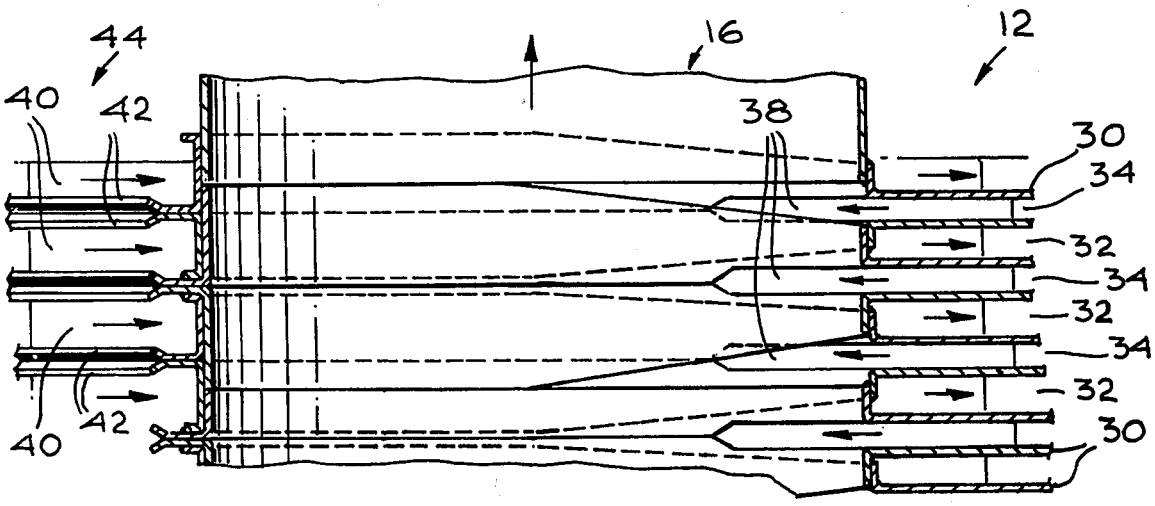
Fig. 5
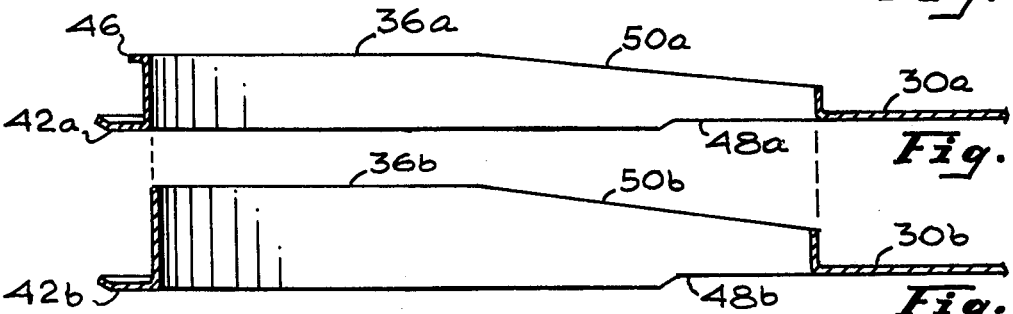
Fig. 6
Fig. 7
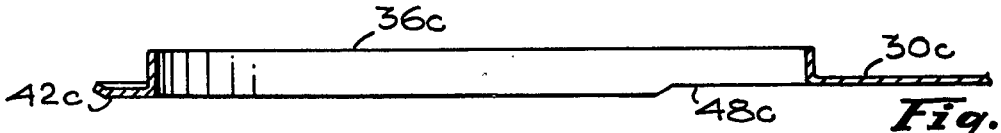
Fig. 8
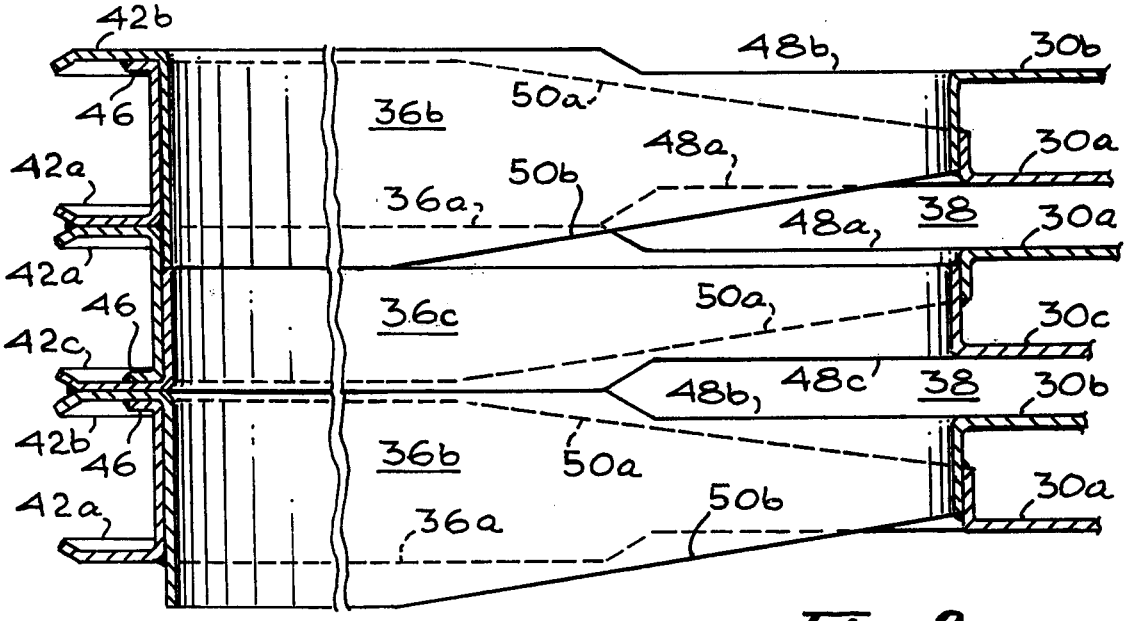
Fig. 9

METHOD OF MANIFOLD CONSTRUCTION FOR FORMED TUBE-SHEET HEAT EXCHANGER AND STRUCTURE FORMED THEREBY

CROSS-REFERENCE TO RELATED APPLICATION

This application is a division of co-pending application Ser. No. 351,439, of Fred. W. Jacobsen et al. for METHOD OF MANIFOLD CONSTRUCTION FOR FORMED TUBE-SHEET HEAT EXCHANGER AND STRUCTURE FORMED THEREBY, filed Apr. 16, 1973 now U.S. Pat. No. 3,894,581.

BACKGROUND OF THE INVENTION

1. Field of the Invention

This invention relates to recuperative heat exchangers of the formed plate type and, in particular, to plate structures adapted to transfer heat from one fluid to another through the surface of the plate and to the methods of forming such.

2. Description of the Prior Art

Recuperative heat exchangers are known in which a plurality of plates of relatively thin material are formed and stacked so as to provide heat transfer through the plates to and from a series of alternate flow passages formed between alternate pairs of plates.

In the interchange of heat between the fluid passages and the heat exchanger, fluids are separated by a plate of high thermal conductivity. In order to obtain the maximum efficiency, the design of the heat exchanger must take into consideration several critical factors. Among these factors which affect the efficiency of design are: (1) the amount of heat transfer area in intimate contact with the fluid, (2) a boundary layer resistance of the plate to the exchange of heat between the fluids. (3) the difference in thermal conductivity of the various parts of the heat exchanger, and (4) the overall structure of the heat exchanger core. The design of prior art heat exchangers has resulted in compromises in design according to the above factors whereby fluid capacity suffers with a decrease in size or vice versa, because of the inability of designing a heat exchanger to optimize all of these factors. For example, strength and reliability of the overall structure dictate some parts of larger size than others resulting in large differences in thermal conductivity of the parts. Conversely, if the parts are of the same size the overall structure may be too weak to stand the pressure and temperature gradients therein or may be too heavy and cumbersome for practical use in any but the most limited applications.

Various attempts have been made to solve the above-noted problems in heat exchangers by designing plate type heat exchangers comprising a series of stacked thin metallic plates which are assembled in face-to-face arrangement to define fluid passages therebetween for separate flow of primary and secondary fluids in the heat exchange relation. A thin plate type of heat exchanger has been generally very difficult to manufacture, due to the many welding and bonding operations required, and difficult to achieve a strong structure because of the thinness of the plate material.

A preferred type of heat exchanger would have a uniform thickness of plate and other components utilized throughout the heat exchanger in order to maintain a uniform thermal conductivity between the parts. In this manner localized adverse expansion and contraction effects encountered during the heating and cooling cycle would be minimized. In the interest of maintaining a low cost of manufacture it would be highly advantageous to make a heat exchanger of plates which are similar in structure and form so as to present surfaces adapted to mate with each other to contribute adequate seals. In prior art heat exchangers typically a module of two plates is provided, wherein the plates are recessed to accommodate the flow of two fluids so as to provide a reliable and effective basis for sealing around the module perimeter as well as adequate structural strength. However, to accomplish this the sealing is generally provided by bars which are welded or brazed to the stacked plates. The great difference in thermal conductivity of the bars, as compared to the thin material of the plates, has a deleterious effect on the heat exchanger, causing undesirable stresses during expansion and contraction of the stacked parts. Thus, the plate type heat exchanger of the prior art, which is formed of a series of plates stacked together in spaced side-by-side relation, has been limited in efficiency due to the above-mentioned disadvantages therein.

Accordingly, it is essential that the heat exchanger be designed with the above-mentioned factors taken into consideration in order to achieve a low cost, high efficiency heat exchanger. In a typical prior art recuperative heat exchanger, the type of construction is usually characterized by a large number of components which result in high labor efforts with resulting high cost of fabrication of the heat exchangers. Structural problems are associated with the thermal inertia incompatibility of the different size core elements and these severely limit the design objective. Existing heat exchangers for large industrial gas turbines realize a fairly low compactness resulting in a unit of extremely large volume and weight. On the other hand, providing a heat exchanger of high compactness results in an extremely high cost of manufacture. Prior attempts at providing a more compact heat exchanger of low cost and high efficiency have met with failure due to the inability to solve the problems set forth above.

The design of a plate type heat exchanger must take into consideration the transient metal temperature differentials between the various parts. These differentials occur during thermal transients and are caused by the temperature time lag of the relatively heavier sections in the core, such as the bars which may be used to enclose the relatively thin stacked plates. These heavier reinforced bars for sealing the gauge manifolds are thermally incompatible with the plates. Additionally, the heavy gauge manifolds which are required for the input and output fluid passages often result in a transient thermal stress at the ends of the core matrix which exceeds the material yield strength. Of course, if the manifold sections were designed of thin materials, the structural strength of the heat exchanger core would be unacceptable.

Thus, it may be seen that a heat exchanger is desired that will achieve the thermal inertia compatibility between the various elements of the core without sacrificing the structural strength and efficiency of the heat exchanger. Such a structure should desirably admit of fabrication without inordinate labor costs to be commercially feasible.

SUMMARY OF THE INVENTION

In brief, particular apparatus in accordance with the present invention utilize a series of formed plates of single unitary structure and relatively thin material, each including integral inlet and outlet manifold sections in combination with a sandwich configuration developing counterflow fluid passages. Each individual plate is formed to provide a deep draw in opposed end sections of the plate, forming collars or cup-like protrusions to permit nesting together with other, similarly formed plates to develop the inlet and outlet air manifold passages. The collars are particularly shaped so as to admit of being nested together and brazed into an integral unit with appropriate reinforcement of the assembled structure at the various juncture lines. Furthermore, the collar manifold sections are fashioned so as to define air openings communicating between the manifold and the interior air passages of the heat exchanger core matrix.

In accordance with an aspect of the invention, three different plate designs are sufficient, when repeated throughout the stacked core structure, to develop the desired structural integrity with the manifold section reinforcement as described, while providing the desired openings between the manifolds and the counter-flow passages. These three plates, designated respectively A-plates, B-plates and C-plates, all have extended flanges about the outer periphery thereof for joining along the flange surface with a corresponding surface of an adjacent plate. One of the designs, the A-plate, is utilized in pairs, relative to the B-plates and C-plates. A pair of A-plates are joined together in abutting relationship with each other at their flange portions. The B- and C-plates are joined to each other in similar abutting relationship overlapping the adjacent A-plate collar juncture line. The B- and C-plates have slightly smaller diameters of their collar portions than do the A-plates in order that they may nest within the collar manifold sections of the A-plates and also to allow adequate gap for a continuous circumferential braze joint. The flange sections of the B- and C-plates are provided with additional reinforcement for rigidity by an extended reentrant section of the collar of the A-plates which overlap the B- and C-plate collar manifoldl-juncture.

In the counter-flow secton of the heat exchanger core, fin element layers are provided for additional strength and rigidity, as well as to break up the smooth flow of air and improve the heat transfer characteristics at the fluid-structure interfaces. Between adjacent pairs of plates defining the air passages are the gas flow passages which extend directly through the core matrix and communicate with the outside thereof at the end portions extending between adjacent air manifolds. The entire core structure may be made up of thin metal elements, the plates being fabricated preferably from 0.010" thickness, type 347 stainless steel. Thus, the thermal stability of the entire structure is exceedingly favorable, since there are no particular structural components having great thermal lag relative to any other components, as is the case in presently known heat exchanger assemblies utilizing reinforcing bars at the core boundaries for sealing and/or reinforcement. Other materials may be employed in heat exchangers of the invention. For example, it has been found that embodiments of the invention may be fabricated of ceramic materials shaped to the desired configuration and then fired to a permanent hardness. The desired properties of materials suitable for use in the practice of the invention are: a low thermal coefficient of expansion with good thermal shock resistance; good tensile strength; and good workability of the material.

BRIEF DESCRIPTION OF THE DRAWING

A better understanding of the present invention may be had from a consideration of the following detailed description taken in conjunction with the accompanying drawing, in which:

FIG. 5 is another sectional view of a portion of the arrangement of FIG. 4 taken at the arrows 5 thereof;

FIG. 6 is a side sectional view showing one of the elements employed in the core of FIG. 4;

FIG. 7 is a side sectional view of another element employed in the arrangement of FIG. 4;

FIG. 8 is a side sectional view of a third element employed in the arrangement of FIG. 4; and FIG. 9 is a side sectional view showing the elements of FIGS. 6—8 nested together to form a portion of the core of FIG. 4.

DESCRIPTION OF THE PREFERRED EMBODIMENTS

Figure 1:
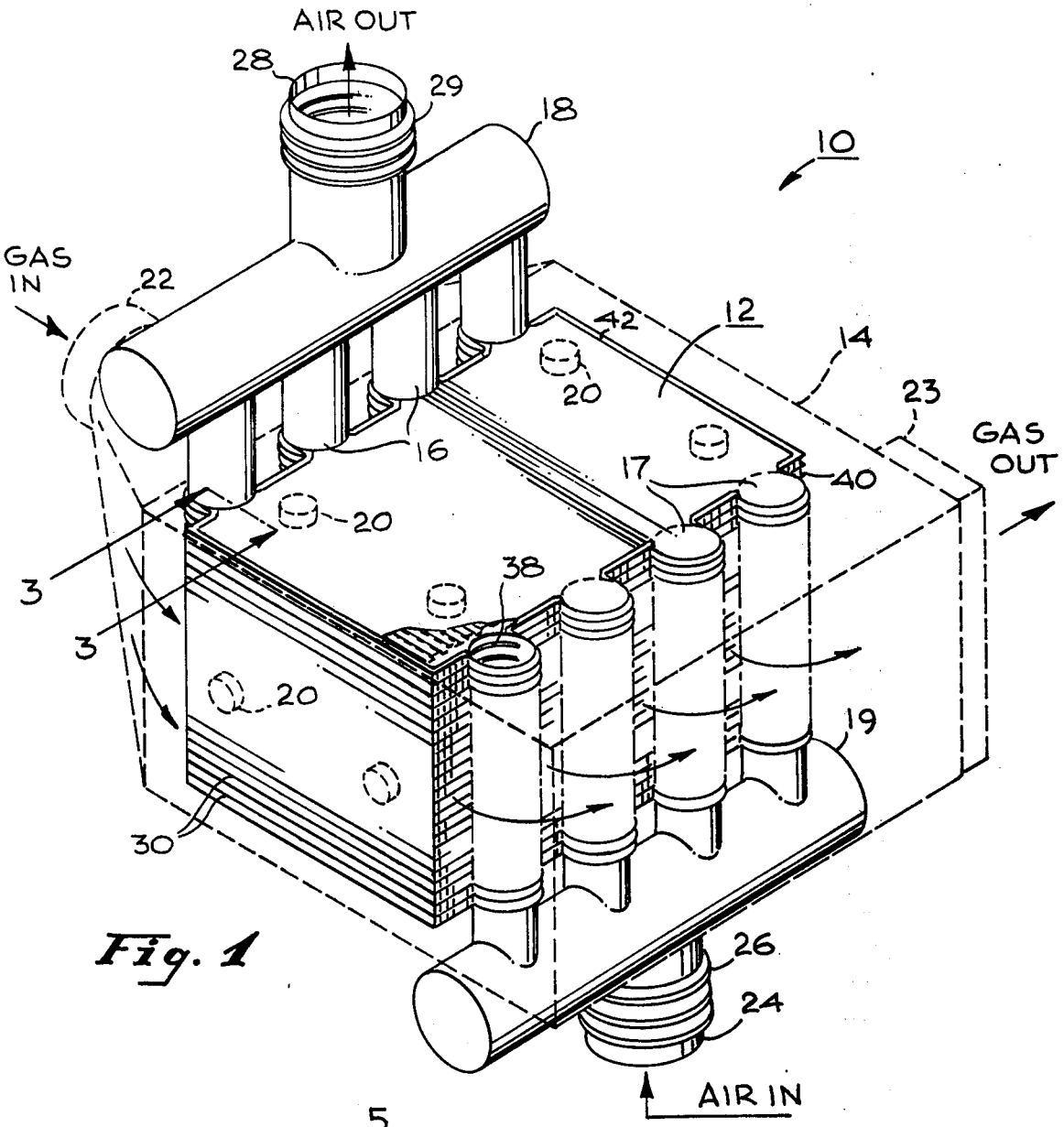
FIG. 1 is a perspective view of one particular arrangement in accordance with the present invention.

The embodiment of the invention as shown in FIG. 1 comprises a heat exchanger assembly 10 having a core 12 enclosed within a housing 14. The core is provided with integrally fashioned manifolds 16, 17 on opposite sides of the central heat exchanger, connected respectively to headers 18, 19. The heat exchanger core 12 is supported within the housing 14 by means of mounts 20. The housing 14 is provided with inlet and outlet passages 22 and 23 for passing a hot gas through the heat exchanger core 12 in intimate heat exchange relationship with air flowing between the respective manifolds 16, 17. In operation, air enters the header 19 through an inlet pipe 24 which incorporates a load compensating bellows portion 26 to adjust for dimensional variation, passes upward into the manifolds 17 and then into the air flow passages in the heat exchanger core 12. The air then flows upward through the manifolds 16 into the header 18 and out through an outlet pipe 28 which is also provided with a load compensating bellows portion 29. At the same time hot gas is flowing into the housing 14 through the inlet duct 22, thence through gas flow passages sandwiched between the air flow passages of the heat exchanger core 12, and finally out of the housing 14 through the outlet duct 23. It will thus be understood that the air and gas flow is in a direct counterflow relationship within the sandwich structure of the heat exchanger core 12.

Figure 2:
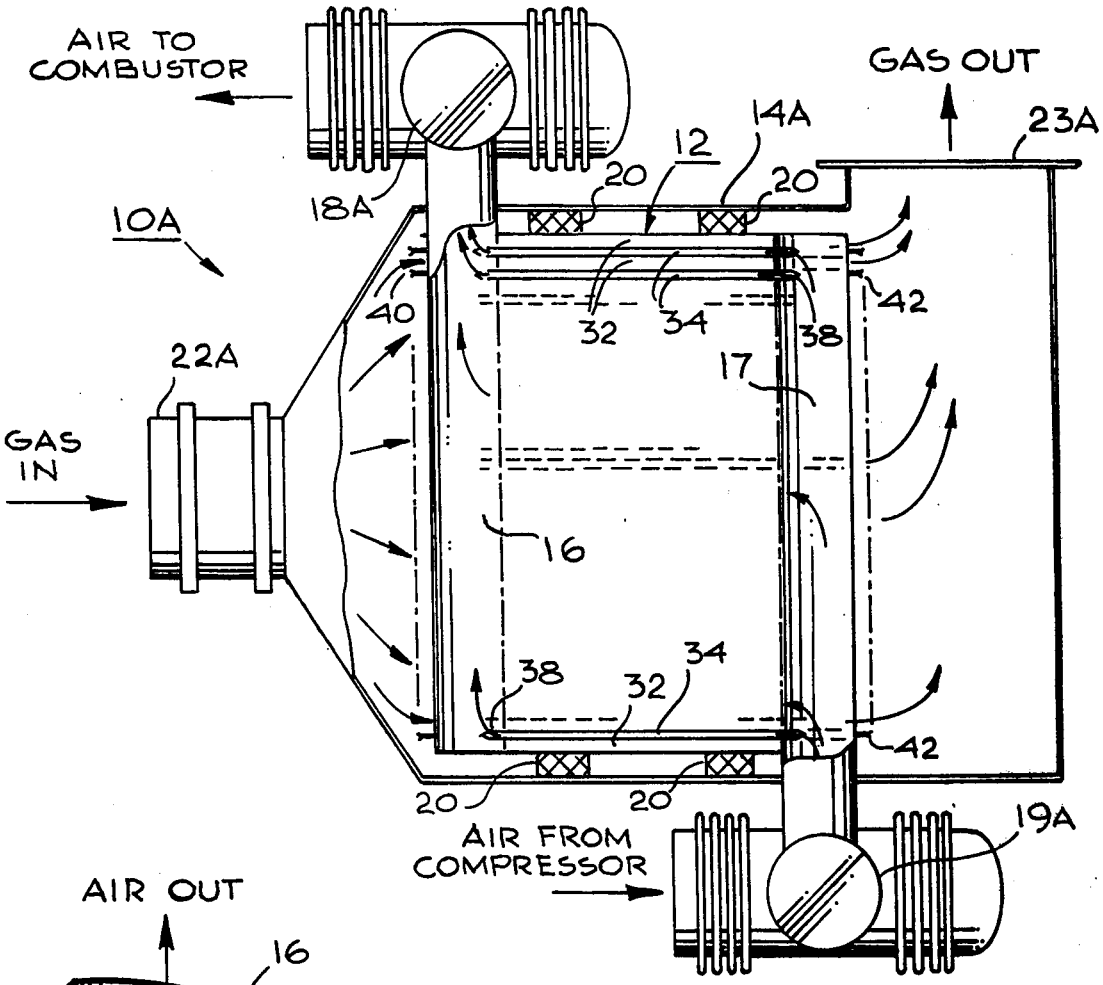
FIG. 2 is a side elevation of another arrangement in accordance with the invention, similar to that of FIG. 1, except that somewhat different housing and headering configurations are shown.

A similar assembly 10A is shown in a sectional elevation view of FIG. 2, in which the same heat exchanger core 12 is employed, but in which a slightly different housing 14A having inlet and outlet ducts 22A, 23A are provided. Also, the headering arrangements 18A and 19A are slightly different from those shown in FIG. 1.

Figure 3:
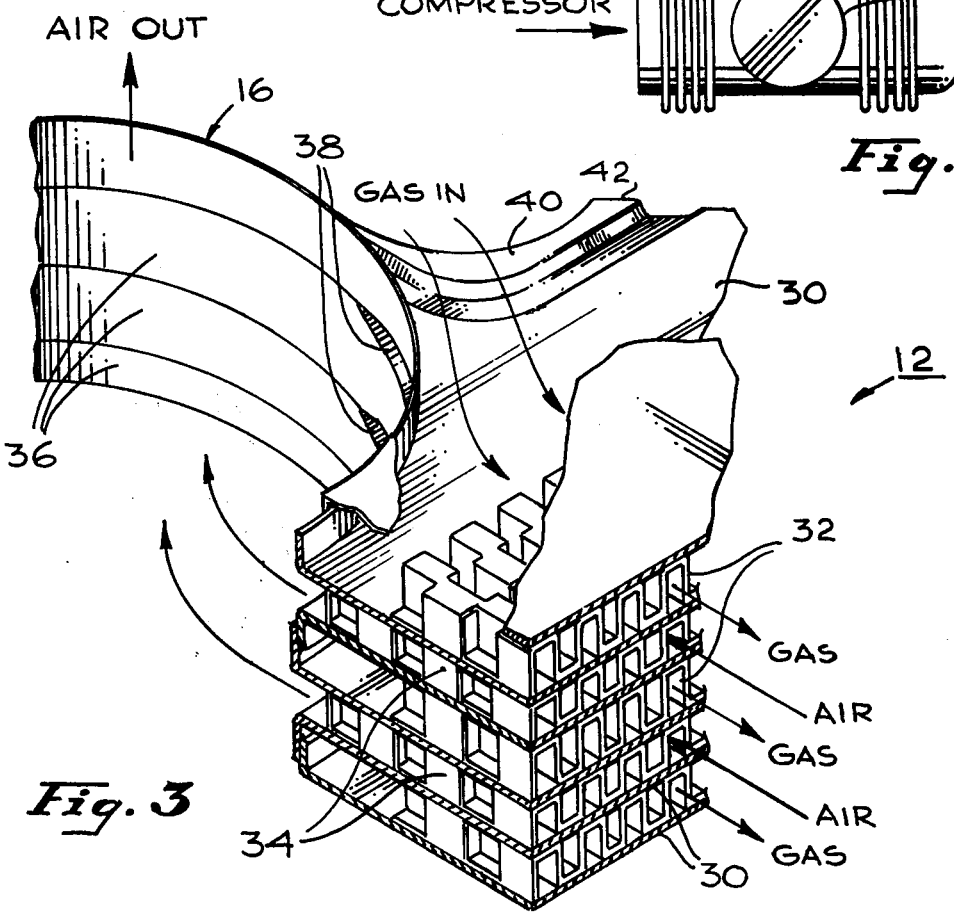
FIG. 3 is a perspective view of a portion of the arrangement of FIG. 1, taken in section at the arrows 3 thereof.

FIG. 3, which is a perspective view, partially broken away and partially in section, shows structural details of the portion of the core 12 at the section line arrows 3—3 of FIG. 1. The portion depicted in FIG. 3 is shown comprising a part of the core section 12 and a part of one of the air manifolds 16. The core section 12 includes a plurality of formed plates 30 sandwiched together with and separated from each other by respective layers of gas fins 32 and air fins 34. The formed plates 30 are provided with collars 36 to develop the manifold 16 extending into the sandwiched structure and define strategically located openings 38 for passing air between the manifold 16 and the air fins 34. Correspondingly, openings are provided at 40 for the passage of hot gasses from the outside of the core 12 to the gas passages containing the gas fins 32. Thus as may be seen from FIG. 3, the respective gas and air fin configurations within the sandwich structure of the core 12 serve to provide a certain rigidity and integrity to the structure while at the same time serving to provide the desired heat transfer between the adjacent gas and air streams while developing the desired turbulence in the respective fluid flows so as to enhance the heat transfer characteristics of the fluid-metal interface.

Figure 4:
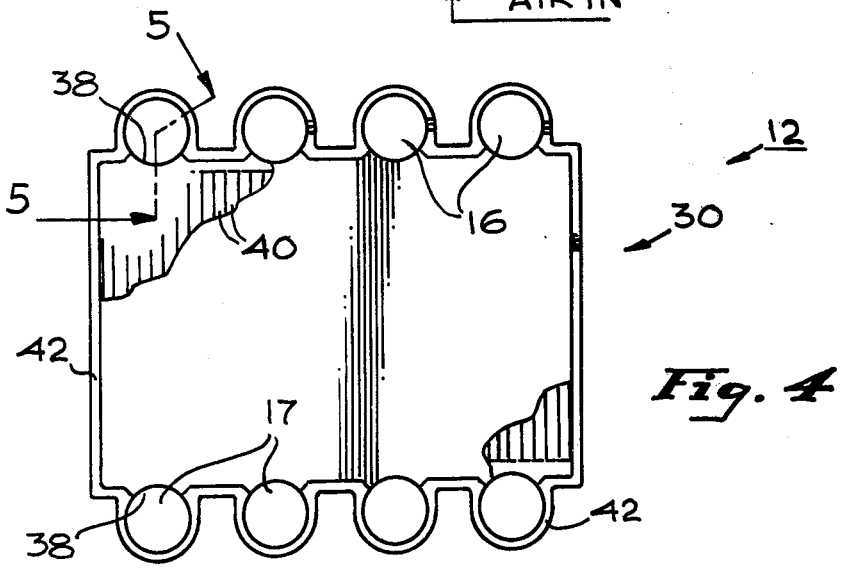
FIG. 4 is a plan view of the heat exchanger core of FIGS. 1 and 2.

FIG. 4 may be considered a plan view of the core 12 of FIG. 1. It may also be considered as representing in general outline form one of the formed plates 30 making up the core 12. As may be best seen in FIG. 4, the plate 30 is provided with an offset flange 42 extending about its periphery. In FIGS. 6, 7 and 8 the flange is designated 42*a*, 42*b* and 42*c*, respectively. This flange is offset relative to the plane of the plate and is for the purpose of joining to a similar flange on the plate of the next layer in the stack so as to define a fluid passage having openings communicating therewith only as indicated hereinabove; i.e., where the fluid passage is an air stream, openings communicating with the manifolds 16 and 17, whereas for a gas stream the openings communicate with the outside of the core 12 at segments between adjacent manifolds 16 or 17. Such a segment may be seen at 44 on the left-hand side of FIG. 5, which is a section of a portion of the core 12 taken along the line 5—5 of FIG. 4 looking in the direction of the arrows. Gas openings 40 and the juncture of adjacent flanges 42 are shown in segment 44 of FIG. 5. Air openings 38 are shown in FIG. 5 on the opposite side of the manifold 16 and communicating therewith.

The respective formed plates 30 which, with the gas fin elements 32 and the air fin elements 34, are nested together to make up the core structure 12 are fabricated in three different configurations. Each plate 30 is formed with a cup-like protrusion providing a collar 36 or a manifold section of each of the individual manifolds 16 and 17. The details of structural configuration of the respective formed plates 30 and the manner in which they are nested together in the core 12 may best be seen by reference to FIGS. 6–9. FIG. 6 shows a portion of plate 30*a* and a cup-like protrusion or collar 36*a*. FIG. 7 similarly depicts a formed plate 30*b* having a cup-like protrusion or collar 36*b*. FIG. 8 shows a corresponding formed plate 30*c* with its collar 36*c*. The plates 30*a*, 30*b* and 30*c* may be referred to respectively as "A-plates," "B-plates," and "C-plates."Each of the collars 36 of FIGS. 6–8 is provided with a corresponding flange portion 42*a*, 42*b* or 42*c* about its outer (left-hand) periphery. The A-plate collar 36*a* also has an additional reentrant portion 46 along the edge of the collar 36*a* opposite the flange 42*a*. It will be noted that the diameters of the collars 36*b* and 36*c* are the same but are slightly less than the diameter of the collar 36*a*, the outside diameters of collars 36*b* and 36*c* being fixed to match the inside diameter of collar 36*a*. Each of the plates of FIGS. 6–8 is provided with an offset or recessed segment 48*a*, 48*b*, 48*c* as the case may be. Also, plates 30*a* and 30*b* of FIGS. 6 and 7 have a diagonal cutout 50*a* or 50*b* removed from their respective collars 36*a* and 36*b* along the edge which is opposite to the offset segments 48*a*, 48*b*.

The manner in which the plates 30 of the core 12 are nested together can best be seen in FIG. 9 which is an enlarged section generally corresponding to FIG. 5. A single sequence of plates 30 comprises two A-plates, one B-plate and one C-plate. The two A-plates are joined in abutting relationship back to back so that their respective flanges 42*a* are together. The sequence may be considered beginning at the top of FIG. 9 with a B-plate juxtaposed in upside down relationship to the way in which the plate 30*b* is shown in FIG. 7, nested within the two abutting A-plates, and followed by a C-plate, also nested within the lower of the two A-plates in abutting relationship with the B-plate above it. The sequence then repeats itself, proceeding in the downward direction in FIG. 9, with another B-plate nested within a pair of abutting A-plates, etc.

For each sequence of four formed plates and nested collars as just described, two air layers with corresponding air openings 38 and two associated gas layers are formed. The upper air opening 38 in FIG. 9 is defined by the juncture of the two offset segments 48*a* of the abutting A-plates. The lower of the two air openings 38 in FIG. 9 is formed by the juncture of the offset segments 48*b* and 48*c* of the abutting B-and C-plates respectively. The diagonal cutouts 50*a* and 50*b* serve to provide the desired clearance for communication between the manifold and the respective air openings 38.

FIG. 9 illustrates the manner in which the configuration and dimensions of the respective A-, B- and C-plates, when nested together as shown, serve to provide reinforcement and strengthening for the manifold portion of the core 12. It will be appreciated that the core 12 is pressurized to substantial pressure levels (e.g., in the vicinity of 100 pounds per square inch) in normal operation. Throughout the extent of the manifold, there is a double layer of collar elements 36 by virtue of the insertion of portions 36*b* and 36*c* within the abutting portions 36*a*. Furthermore, the collar 36*b* overlaps the abutting portion of the two A-plates as the flanges 42*a*. Moreover, where the B and C plates abut at collar portions 36*b* and 36*c* without the possibility of an overlapping joint, additional reinforcement is provided for the juncture of the flanges 42*b* and 42*c* by the re-entrant portions 46 of the adjacent A-plates. Strengthening of the respective junctures in this fashion serves to resist the so-called "bellows" effect in which a simple flanged plate structure tends to expand in bellows fashion when subjected to pressurized fluids flowing therethrough. Simple flanged structures tend to develop leaks and ruptures about the juncture lines because of failure of the soldering or brazed joint in tension or through successive flexing cycles. The present structure advantageously serves to provide the necessary reinforcement to prevent or minimize the incidents of failure in this manner. Moreover, the configuration of the core structure readily admits of repair by soldering or brazing when a leak or rupture is encountered, since such a failure will occur at a juncture line and all juncture lines, either inside or outside the manifold, are readily accessible to the implements needed to repair the rupture.

Various configurations of elements may be employed to develop the gas and air layers in the sandwich structure of the heat exchanger core. These may include the finned elements as disclosed, which themselves may be of various types. For example, a plain rectangular or rectangular offset fin may be employed. The fins may be triangular or wavy, smooth, perforated or louvered. As an alternative to the plate-fin structure, a pin-fin configuration may be employed. Alternatively, tubular surface geometries may be utilized which encompass configurations of plain tube, dimpled tube and disc finned tube structures. Also, strip finned tube and concentric finned tube configurations may be employed. Some of these structures may be more adaptable to cross-flow than the counter-flow arrangements of the present invention. However, where the structures are utilizable in counter-flow configurations, they may be employed within the scope of the invention.

In the fabrication of arrangements in accordance with the invention, the respective plate and fin elements are first prepared, including the structures for the inlet and outlet openings. The plates are formed by successive strike operations. The first strike forms the inner draw depth for the central core, fin containment region and the deep manifold collar section with its cup-like protrusion. A second strike forms the outer plate periphery, including the sealing peripheral flange. Next a trim strike removes the peripheral excess sheet stock as well as the cutout portions of the manifold collar sections. The fin elements are formed according to the type of fin being employed. The various parts are then cleaned as by immersion or spraying with suitable solvents. An ultransonic cleaning tank may be used if desired. A selected brazing alloy is then deposited on all surfaces which are to be brazed and the various elements are stacked together into an assembly corresponding to the core matrix which is to be fabricated. The assembled parts are then brazed in a controlled atmosphere furnace until all adjacent surfaces are properly brazed. After the completion of the braze operation, the headers 18 and 19 (FIG. 1) and the remainder of the integral air inlet and air outlet ducting are attached to the core matrix and the assembly is then ready for mounting in its housing.

An important feature of the apparatus in accordance with the invention is the method of fabrication such that the structure is provided with integral sheet or plate closures and integral manifolds. This is accomplished by the provision of flange junctures along all closure lines or the combination of flange junctures with overlapping collar segments in the manifold sections. Apparatus fabricated in accordance with the present invention dispenses with the need for special boundary sealing or support elements, such as the header bars which may be employed about the periphery of heat exchangers of the prior art. This is particularly important in applications of apparatus of the present invention where the weight of the structure is a critical factor, as in utilization of the apparatus in motor vehicle, turbine type power plants, because of the problems encountered with thermal stresses where thick-thin material structure is employed. In apparatus in accordance with the present invention, the respective components are all more or less of the same general thickness so that such problems are avoided.

Although there have been described hereinabove specific methods and apparatus of formed plate, counter-flow fluid heat exchanger structures in accordance with the invention for the purpose of illustrating the manner in which the invention may be used to advantage, it will be appreciated. that the invention is not limited thereto. Accordingly, any and all modifications, variations or equivalent arrangements which may occur to those skilled in the art should be considered to be within the scope of the invention as defined in the attached claims.

What is claimed is:

1. The method of fabricating heat exchanger apparatus of the counter-flow type having inlet and outlet manifolds integrally combined with a heat exchanger core comprising the steps of:

forming a plurality of first plates to have an offset flange extending about the periphery of the plate, said flange being offset relative to the plane of the plate, and a protruding collar of intermediate depth surrounding a corresponding manifold section opening in each of the respective end sections at opposite ends of a central section;

forming a plurality of second plates to have an offset flange extending about the periphery of the plate, said flange being offset relative to the plane of the plate, and a protruding collar of depth greater than said intermediate depth surrounding a corresponding manifold section opening in each of the respective end sections at opposite ends of a central section;

forming a plurality of third plates to have an offset flange extending about the periphery of the plate, said flange being offset relative to the plane of the plate, and a protruding collar of depth less than said intermediate depth surrounding a corresponding manifold section opening in each of the respective end sections at opposite ends of a central section;

cleaning the plates and elements to be joined;

depositing a brazing alloy on all surfaces which are to be brazed;

stacking first plates by pairs and second and third plates by pairs in flange-to-flange relationship with each other to define manifold sections communicating with associated passages for a first fluid in the central sections and passages for a second fluid extending through the central sections and having openings at opposed ends of the core;

brazing the assembled parts in a controlled atmosphere furnace until all adjacent surfaces are brazed; and attaching integral fluid ducting to the brazed assembly.

2. The method of claim 1 wherein the steps of forming the pluralities of second and third plates includes the step of forming the protruding collars to have outside diameters dimensioned to fit snugly within the inside diameters of the collars of a first plate.

3. The method of claim 1 wherein the stacking step comprises the steps of stacking a pair of first plates in back-to-back relationship, and stacking a second plate and a third plate in back-to-back relationship.

4. The method of claim 3 wherein the stacking step further includes the step of nesting the collar portions of the back-to-back pair of second and third plates within the collar portions of the back-to-back pair of said first plates.

5. The method of claim 1 wherein the step of forming each of the plates includes providing an offset segment in each of said collars to define, with a corresponding offset segment in an adjacent collar when the plates are stacked to form the core, an opening in an associated manifold section.

6. The method of claim 5 wherein the steps of forming the first and second plates further include establishing a diagonal cutout along the collars thereof in a region adjacent the central sections.

* * * * *